US006675819B2

(12) United States Patent
Arrowood et al.

(10) Patent No.: US 6,675,819 B2
(45) Date of Patent: Jan. 13, 2004

(54) MOUNTING DEVICE FOR A BEACH UMBRELLA

(76) Inventors: Lynn B. Arrowood, 695 Linwood Rd., Mooresville, NC (US) 28115; Ernest C. Arrowood, 2180 Two First Union Center, Mooresville, NC (US) 28282

( * ) Notice: Subject to any disclaimer, the term of this patent is extended or adjusted under 35 U.S.C. 154(b) by 5 days.

(21) Appl. No.: 10/039,921

(22) Filed: Oct. 29, 2001

(65) Prior Publication Data

US 2003/0079766 A1 May 1, 2003

(51) Int. Cl.[7] ..... A45B 3/00

(52) U.S. Cl. ..... 135/16; 135/98; 135/118; 248/530; 248/156; 248/413; 403/362

(58) Field of Search ..... 135/16, 117, 118, 135/19, 15.1, 98–99; 248/156, 530, 527, 413, 125.8, 121; 108/50.12; D6/416–417; 47/41.14; 403/362

(56) References Cited

U.S. PATENT DOCUMENTS

| | | | | | |
|---|---|---|---|---|---|
| 176,559 | A | | 4/1876 | Springer | |
| 1,366,872 | A | * | 1/1921 | Cantleberry | 248/125.1 |
| 2,597,157 | A | * | 5/1952 | Martino | 248/156 |
| 3,285,554 | A | * | 11/1966 | Voelkerding | 248/121 |
| 4,154,255 | A | | 5/1979 | Weaver | |
| 4,406,437 | A | * | 9/1983 | Wright | 248/529 |
| 4,454,824 | A | | 6/1984 | Wood | |
| 4,920,897 | A | * | 5/1990 | Reed et al. | 248/156 |
| 5,046,699 | A | * | 9/1991 | Perreault et al. | 135/16 |
| 5,135,191 | A | * | 8/1992 | Schmuhl | 248/125.1 |
| 5,143,108 | A | | 9/1992 | Kenney | |
| 5,293,889 | A | | 3/1994 | Hall et al. | |
| 5,294,083 | A | | 3/1994 | Roth | |
| 5,363,607 | A | * | 11/1994 | Turturro | 248/533 |
| 5,396,916 | A | * | 3/1995 | Boissonnault | 135/16 |
| 5,482,246 | A | * | 1/1996 | Derkoski | 248/530 |
| 5,505,645 | A | * | 4/1996 | Engler, Jr. | 135/16 |
| D385,508 | S | * | 10/1997 | Regier | D11/181 |
| D385,716 | S | * | 11/1997 | Hudson et al. | D6/417 |
| 5,692,720 | A | * | 12/1997 | Griggs | 135/15.1 |
| 5,772,162 | A | * | 6/1998 | Lin | 248/121 |
| 5,823,496 | A | * | 10/1998 | Foley et al. | 248/156 |
| 5,906,077 | A | * | 5/1999 | Andiarena | 135/118 |
| 6,267,127 | B1 | | 7/2001 | Doreste | |
| 6,401,656 | B1 | * | 6/2002 | Adkisson | 119/51.01 |
| 6,443,172 | B2 | * | 9/2002 | Brumfield | 135/16 |

FOREIGN PATENT DOCUMENTS

| | | | | |
|---|---|---|---|---|
| EP | 312675 | * | 4/1989 | 135/15.1 |

* cited by examiner

*Primary Examiner*—Winnie Yip
(74) *Attorney, Agent, or Firm*—Schwartz Law Firm, P.C.

(57) ABSTRACT

A mounting device for a beach umbrella includes a hollow tubular base having an open tapered end adapted for penetrating a ground surface and an opposing open end adapted for receiving an elongated mounting post of the beach umbrella. At least one outwardly projecting support arm is attached to the tubular base, and is adapted for carrying beach items and accessories above the ground surface.

1 Claim, 3 Drawing Sheets

MOUNTING DEVICE FOR A BEACH UMBRELLA

TECHNICAL FIELD AND BACKGROUND OF INVENTION

This application relates to a mounting device for a beach umbrella. The invention securely mounts a beach umbrella in the sand without the use of cumbersome anchoring structure or mounting tools. The invention is further applicable for carrying beach items, such as towels, beverage containers, tote bags, articles of clothing, and the like.

Self-anchoring beach umbrellas are well known the prior art. These umbrellas are typically formed in sections, and have a tapered base intended for being driven into the sand. To facilitate ground penetration, an outer screw vane or thread is generally formed with the base. In many cases, separate external support means are required for additional anchoring. The location of the umbrella canopy is determined by the amount of base driven into the sand. In areas of hard sand, properly mounting the base can be difficult and often requires use of a hammer, shovel, or other suitable tool.

In addition to anchoring concerns, traditional beach umbrellas have no convenient means for storing beach items above the sand. Such items are typically carried on one or more of the rib supports in a small open space beneath the umbrella canopy. Relatively large and heavy items are generally difficult to position, and often create balancing problems.

The mounting device of the present invention addresses these and other problems associated with traditional and self-anchoring beach umbrellas. The invention easily penetrates the ground surface, and provides a secure anchor for mounting the beach umbrella in the sand. The height of the umbrella canopy is readily adjustable without additional digging or ground penetration. The invention also provides structure for conveniently locating and storing beach items above the sand.

SUMMARY OF INVENTION

Therefore, it is an object of the invention to provide an umbrella mounting device for anchoring a beach umbrella in the sand.

It is another object of the invention to provide an umbrella mounting device which readily penetrates the ground surface.

It is another object of the invention to provide an umbrella mounting device which is applicable for use with any traditional beach umbrella.

It is another object of the invention to provide an umbrella mounting device which preserves the mounting post of the beach umbrella.

It is another object of the invention to provide an umbrella mounting device which is lightweight and easy to transport.

It is another object of the invention to provide an umbrella mounting device which is relatively inexpensive to manufacture.

It is another object of the invention to provide an umbrella mounting device which is applicable for carrying beach items, such as towels, beverage containers, tote bags, articles of clothing, and the like.

It is another object of the invention to provide an umbrella mounting device which allows quick and convenient height adjustment of the umbrella canopy.

It is another object of the invention to provide an umbrella mounting device which is weather-resistant.

It is another object of the invention to provide a mounting device adapted for holding beach items, and which may or may not be used with a beach umbrella.

It is another object of the invention to provide a method for mounting a beach umbrella.

These and other objects of the present invention are achieved in the preferred embodiments disclosed below by providing a mounting device for a beach umbrella. The mounting device includes a hollow tubular base having an open tapered end adapted for penetrating a ground surface and an opposing open end adapted for receiving an elongated mounting post of the beach umbrella. At least one outwardly projecting support arm is attached to the tubular base, and is adapted for carrying beach items and accessories above the ground surface.

The term "beach umbrella" as used herein refers broadly to any umbrella having a canopy and a mounting post suitable for driving into a ground surface.

According to another preferred embodiment of the invention, the base includes upper and lower base sections having respective proximal and distal ends. The upper and lower base sections are removably connected together at their respective proximal ends.

According to another preferred embodiment of the invention, the proximal end of the upper base section includes an enlarged joint adapted for receiving the proximal end of the lower base section.

According to another preferred embodiment of the invention, the joint includes a set screw adapted for engaging the mounting post of the beach umbrella such that only a select portion of the mounting post is received within the base in order to position a canopy of the beach umbrella a desired distance above the ground surface.

According to another preferred embodiment of the invention, the support arm includes a cup holder adapted for holding a beverage container.

According to another preferred embodiment of the invention, the support arm includes an upwardly turned free end.

According to another preferred embodiment of the invention, the open tapered end of the tubular base is cut at an angle of approximately 60 degrees.

In another embodiment, the invention is a mounting device for a beach umbrella. The mounting device includes a hollow tubular base having an open tapered end adapted for penetrating a ground surface and an opposing open end adapted for receiving an elongated mounting post of the beach umbrella. A plurality of outwardly projecting support arms are attached to the tubular base and adapted for carrying beach items and accessories above the ground surface. At least one of the support arms includes a cup holder for holding a beverage container.

In yet another embodiment, the invention is a method for mounting a beach umbrella. The method includes the steps of driving a hollow tubular base into a ground surface. The base has an open tapered end adapted for penetrating the ground surface and an opposing open end adapted for receiving an elongated mounting post of the beach umbrella. The mounting post of the beach umbrella is then inserted into the hollow tubular base.

According to another preferred embodiment of the invention, the method includes inserting a select portion of the mounting post into the tubular base to position a canopy of the beach umbrella a desired distance above the ground surface.

In yet another embodiment, the invention may be used without the beach umbrella.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
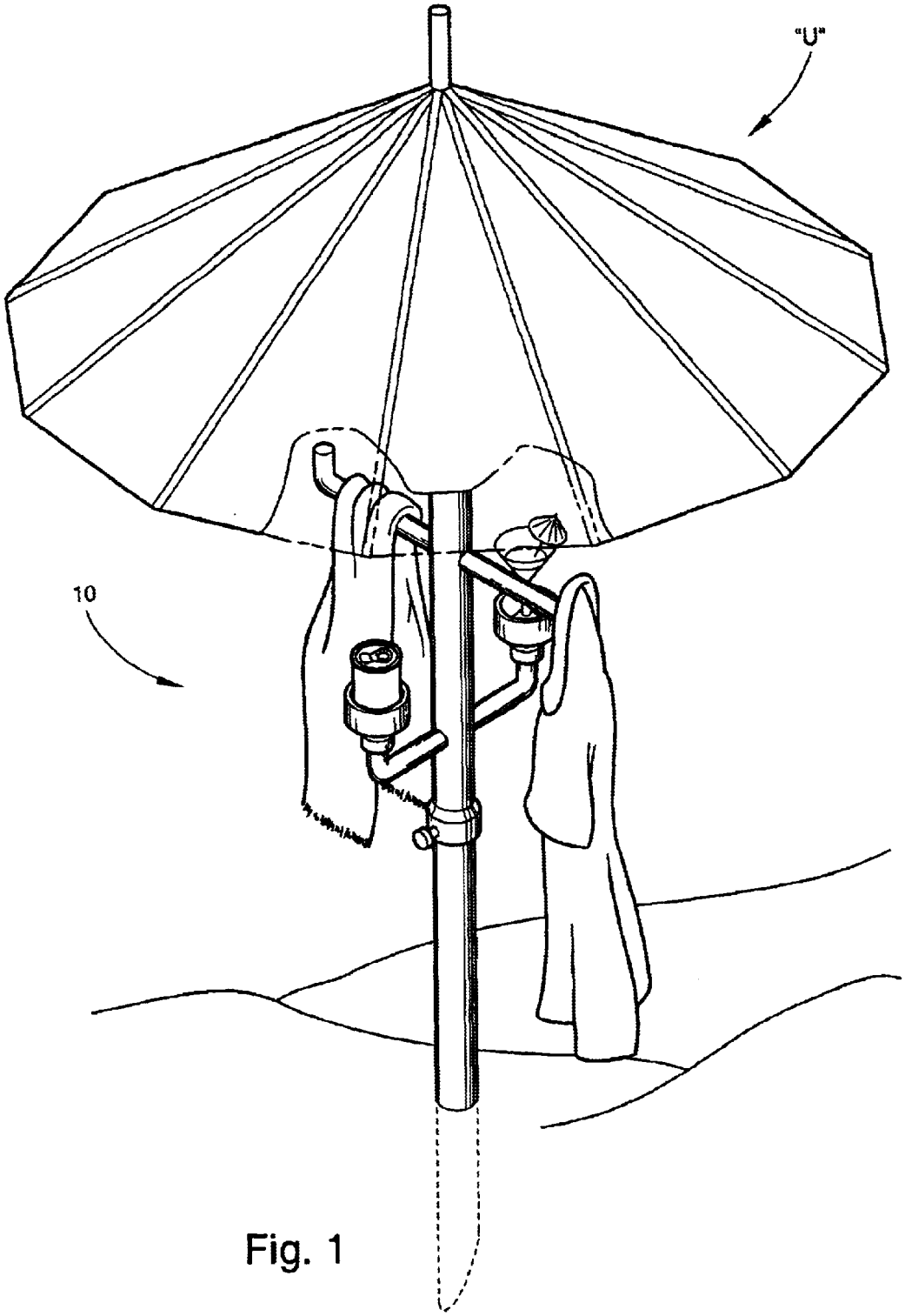
FIG. 1 is an environmental perspective view of an umbrella mounting device according to one preferred embodiment of the invention.

Referring now specifically to the drawings, an umbrella mounting device according to the present invention is illustrated in FIG. 1, and shown generally at reference numeral 10. The mounting device 10 is especially useful at the beach for conveniently mounting a beach umbrella "U" in the sand, and for carrying items such as beverage containers, beach towels, and articles of clothing.

Figure 2:
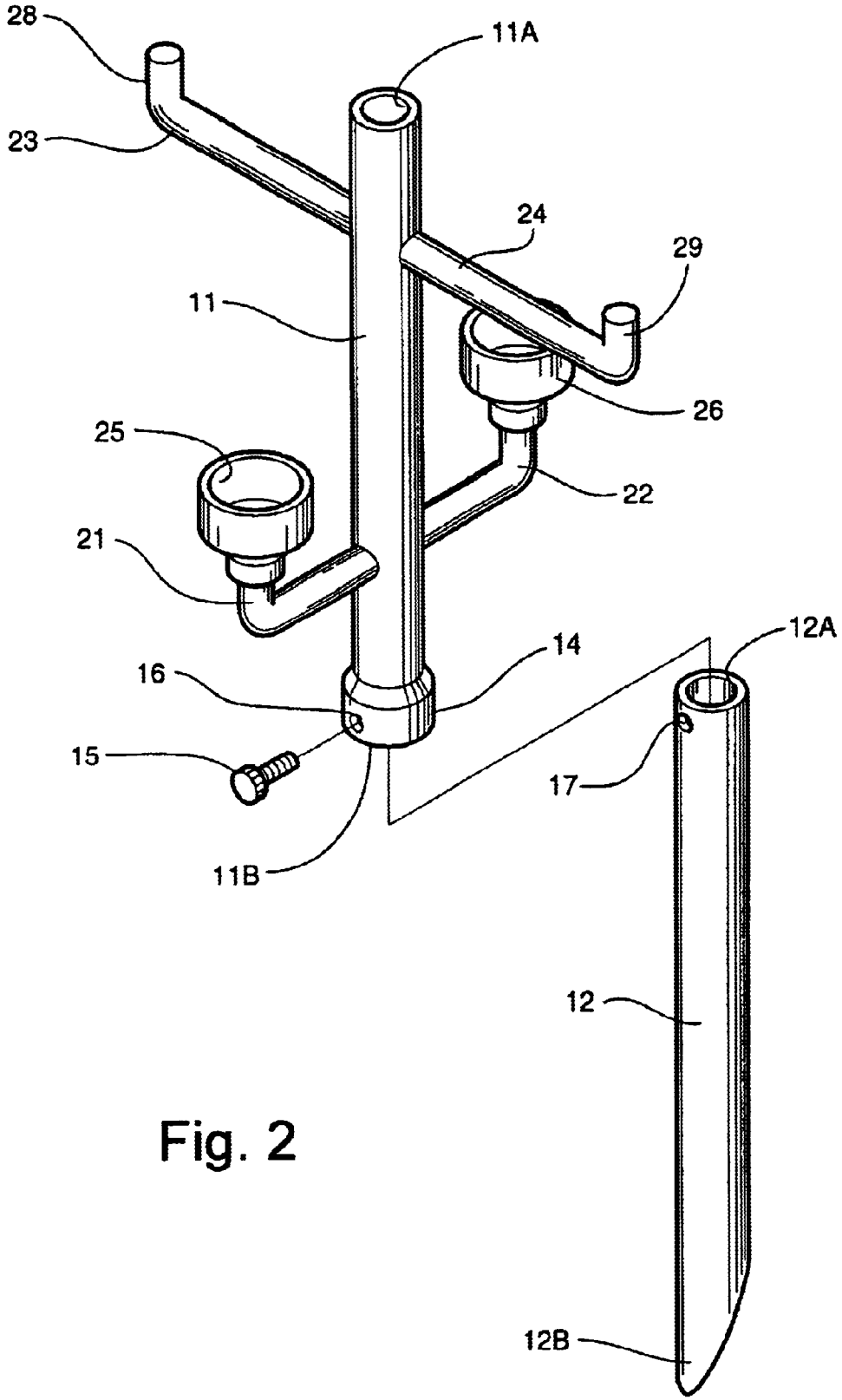
FIG. 2 is perspective view of the umbrella mounting device with the upper and lower base sections pulled apart.
Figure 3:
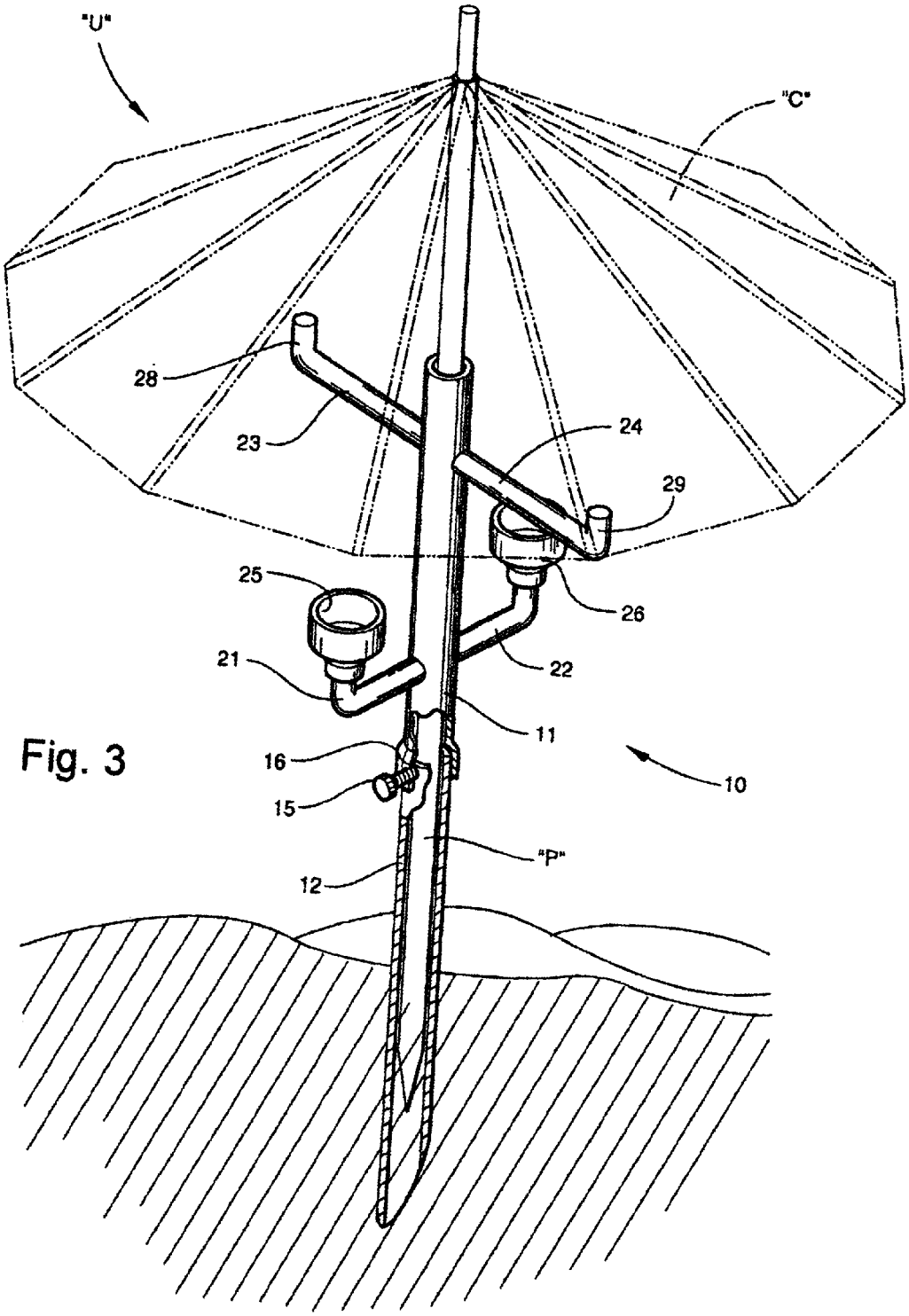
FIG. 3 is a partial cross-sectional view of the umbrella mounting device and showing the mounting post of the umbrella extending within the upper and lower base sections.

As best shown in FIGS. 2 and 3, the umbrella mounting device 10 includes a hollow tubular base formed in upper and lower base sections 11 and 12. The base sections 11 and 12 have respective proximal and distal ends 11A, 11B and 12A, 12B. An enlarged joint 14 is formed at the proximal end 11B of the upper base section 11, and is adapted to receive the proximal end 12A of the lower base section 12. The distal end 12B of the lower base section 12 is tapered at an angle of approximately 60 degrees. Because of its open-ended tapered construction, the distal end 12B readily penetrates deep within the ground surface to secure the umbrella mounting device 10 in the sand without the use of an outer screw vane or other external anchoring structure. The opposing distal end 11A of the upper base section 11 is open to receive the mounting post of the beach umbrella "U". The mounting post "P" extends through the tubular base sections 11 and 12, as shown in FIG. 3, and is held in a set position by a threaded set screw 15. The set screw 15 passes through aligned, complementary-threaded holes 16 and 17 formed in the enlarged joint 14 of the upper base section 11 and proximal end 12A of the lower base section 12 to engage the mounting post "P" of the umbrella "U". After locating the umbrella canopy "C" at a desired height, the set screw 15 is manually tightened against the mounting post "P" to hold the umbrella "U" in the selected position. The umbrella "U" is thereafter conveniently removed from the mounting device 10 by loosening the set screw 15 and lifting the umbrella post "P" out of the hollow base sections 11 and 12. The set screw 15 further serves to removably lock the upper and lower base sections 11 and 12 together.

The upper base section 11 preferably includes respective pairs of support arms 21, 22 and 23, 24. Support arms 21 and 22 include cup holders 25 and 26, respectively, adapted for holding beverage containers. Support arms 23 and 24 have respective upwardly-turned free ends 28 and 29, and are particularly suited for carrying beach towels, articles of clothing, and the like.

According to one preferred embodiment, the upper and lower base sections 11 and 12 of the umbrella mounting device 10 are formed of a molded polymeric material, such as PVC plastic. The support arms 21–24 may be integrally molded with the upper base section 11 or otherwise permanently glued or heat welded to the plastic base. Alternatively, for more convenient packaging and transport, the support arms 21–24 may be detachably connected using mating screw threads, a snap or press fit, or other suitable connecting means. The inside diameter of the tubular base sections 11 and 12 is preferably between 2–3 inches. The overall length of the base from the distal end 11A of the upper base section 11 to the tapered end 12B of the lower base section 12 is approximately 3–4 feet.

A mounting device for a beach umbrella is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

We claim:

1. In combination with a beach umbrella, a mounting device for mounting said beach umbrella in a ground surface, said mounting device comprising:

(a) an elongated hollow tubular base formed of a polymeric material and comprising upper and lower base sections having respective proximal and distal ends, the base sections being joined together at their respective proximal ends and defining a continuous interior throughbore extending from an open top end of said base to an open bottom end of said base, the top open end receiving an elongated mounting post of said beach umbrella, and the bottom open end being tapered at an angle of approximately 60 degrees to penetrate a ground surface, and the interior throughbore having a relatively constant interior diameter of between 2 and 3 inches;

(b) an enlarged joint formed with the proximal end of one of said upper and lower base sections and receiving the proximal end of the other of said upper and lower base sections;

(c) a set screw extending through respective aligned openings formed in said enlarged joint of the one of said upper and lower base sections and the proximal end of the other of said upper and lower base sections, said set screw extending partially into said interior throughbore and engaging the mounting post of said beach umbrella such that only a select portion of the mounting post is received within said base to position a canopy of the beach umbrella a desired distance above the ground surface; and (d) a plurality of outwardly projecting support arms attached to the upper base section of said tubular base, said plurality of support arms consisting of a first pair of support arms extending coaxially outwardly on opposite sides of said tubular base and comprising respective cup holders for holding beverage containers, and a second pair of support arms extending coaxially outwardly on opposite sides of said tubular base offset from said first pair of support arms and at a point vertically spaced apart from said first pair of support arms, said second pair of support arms having respective upwardly turned free ends adapted for carrying beach items and accessories above the ground surface.

* * * * *